US007174865B2

(12) United States Patent
Sakita

(10) Patent No.: US 7,174,865 B2
(45) Date of Patent: Feb. 13, 2007

(54) ENGINE WITH A VARIABLE COMPRESSION RATIO

(76) Inventor: Masami Sakita, P.O. Box 61089, Palo Alto, CA (US) 94306-1089

( * ) Notice: Subject to any disclaimer, the term of this patent is extended or adjusted under 35 U.S.C. 154(b) by 0 days.

(21) Appl. No.: 11/177,888

(22) Filed: Jul. 8, 2005

(65) Prior Publication Data

US 2006/0011156 A1 Jan. 19, 2006

Related U.S. Application Data

(63) Continuation-in-part of application No. 10/893,831, filed on Jul. 19, 2004, now Pat. No. 7,007,640.

(51) Int. Cl.
*F02B 75/04* (2006.01)
*F02B 75/32* (2006.01)

(52) U.S. Cl. ..... 123/78 F; 123/197.4

(58) Field of Classification Search ..... 123/48 B, 123/78 F, 78 R, 48 R, 48 D, 197.4
See application file for complete search history.

(56) References Cited

U.S. PATENT DOCUMENTS 4,998,511 A 3/1991 Van Avermete
5,443,043 A 8/1995 Nilson et al.
5,908,014 A 6/1999 Leighthinger
6,202,623 B1 3/2001 Ehrlich
6,247,430 B1 6/2001 Yapici
6,260,532 B1 * 7/2001 Mendler ..... 123/192.2
6,443,107 B1 9/2002 Mendler
6,450,136 B1 9/2002 Klomp et al.
6,588,384 B2 7/2003 Yapici

* cited by examiner

*Primary Examiner*—Stephen K. Cronin
*Assistant Examiner*—Hyder Ali

(57) ABSTRACT

A VCR engine includes a crankshaft, a driveshaft, a plurality of crankshaft-driveshaft arm assemblies, a means to lift the crankshaft up and down, and a transmission assembly. The crankshaft-driveshaft arm assembly is a piece of metal to which a bearing that holds the crankshaft and another bearing that holds the driveshaft are affixed. The means to lift up and down the crankshaft of the preferred embodiment of this invention includes a plurality of jackscrew assemblies. When the crankshaft is lifted or lowered, the crankshaft will only move around the driveshaft with a fixed radius. The transmission assembly, which is generally a set of gears, transmits rotational movements of the crankshaft to the driveshaft.

8 Claims, 8 Drawing Sheets

ENGINE WITH A VARIABLE COMPRESSION RATIO

RELATED APPLICATION

This application is a continuation-in-part of application Ser. No. 10/893,831 filed on Jul. 19, 2004 now U.S. Pat. No. 7,007,640 entitled Engine With a Variable Compression Ratio.

FIELD OF THE INVENTION

This invention relates generally to an internal combustion engine that operates with a variable compression ratio.

BACKGROUND OF THE INVENTION

The concept of an internal combustion engine with a variable compression ratio (VCR) has existed for more than 100 years. Probably the earliest U.S. Patent on a VCR was U.S. Pat. No. 651,966 by Fleury, issued in 1900. Since then, over 70 U.S. Patents have been issued on engines with VCR systems or on VCR mechanisms. In 2000, Saab displayed the SVC (Saab variable compression) engine in the Geneva auto show, and since then VCR has attracted enormous attention.

The VCR engine displayed by Saab divides the engine into two parts—engine head and crankcase section (U.S. Pat. No. 5,443,043 by Nilsson et al.). The engine head includes the piston cylinder block, and the crankcase includes a crankshaft. The engine is capable of tilting its head while keeping the crankcase straight up. Tilting of the head causes a change in cylinder volume, but the change in cylinder volume is most pronounced when the volume is minimum, and thus the compression ratio changes.

A VCR engine of different design by Ehrlich (U.S. Pat. No. 6,202,623 B1) uses modified crank pin design. In Ehrlich's engine, the metal member that is used as a bearing of the crank pin has two holes (one for the connecting rod pin bearing and the other for the crank pin bearing) and the trajectory of the rotational axis of the crank pin can be changed by a handle that is affixed to the metal member that holds the crank pin bearing.

A VCR engine of another design by Yapici (U.S. Pat. No. 6,588,384) uses eccentric rings that support the crankshaft. The crankshaft is moved up and down by rotating the eccentric rings. The engine's rotational force is outputted through concentric inner gear affixed to the flywheel. The invention by Yapici teaches that an engine equipped with his VCR mechanism does not require significant modification of the engine design.

These VCR mechanisms, however, have weaknesses also. In the engine invented by Nilsson et al., the connection of the engine with the exhaust system must be made flexible enough to absorb the continuous movement of the engine if the exhaust system is kept stationary. In the engine invented by Ehrlich, the VCR mechanism adds extra inertia and friction-causing parts, and thus frictional loss must increase, especially at high-speed operation. In the engine by Yapici, the spur gear teeth of the eccentric rings must bear the force due to the reciprocating movements of the piston.

OBJECTS OF THE INVENTION

An object of this invention is the provision of a VCR engine that is structurally strong enough for a long time use.

An object of this invention is the provision of a VCR engine that has locking capability on an on-line, real-time basis.

An object of this invention is the provision of a VCR engine that does not excessively stress the engine frame or any parts of the VCR mechanism.

SUMMARY OF THE INVENTION

The engine of the present invention is equipped with a mechanism that enables VCR operation. The engine has a driveshaft through which the engine's output is transmitted to the (externally located) transmission, and a crankshaft that functions generally in the same manner as the crankshaft of any reciprocating engine except that its output must be transmitted to the driveshaft. The rotational axis of the driveshaft is parallel to the rotational axis of the crankshaft. The engine includes a crankshaft, a driveshaft, a plurality of crankshaft-driveshaft arm assemblies, a means to lift the crankshaft up and down, and a transmission assembly.

The crankshaft-driveshaft arm assembly is a piece of metal to which a bearing that holds the crankshaft and another bearing that holds the driveshaft are affixed. The means to lift up and down the crankshaft includes a motor, gears and gear shafts, and a plurality of jackscrew assemblies in the preferred embodiment. The means to lift up and down the crankshaft includes worm gear assemblies in an alternative embodiment. When the crankshaft is lifted up and down, the crankshaft will only move around the driveshaft with a fixed radius. The transmission assembly, which is generally a set of gears, transmits rotational movements of the crankshaft to the driveshaft.

BRIEF DESCRIPTION OF THE DRAWINGS

The above description and other objects and advantages of this invention will become more clearly understood from the following description when considered with the accompanying drawings. It should be understood that the drawings are for purposes of illustration only and not by way of limitation of the invention. In the drawings, like reference characters refer to the same parts in the several views.

DETAILED DESCRIPTION OF THE INVENTION

Figure 1:
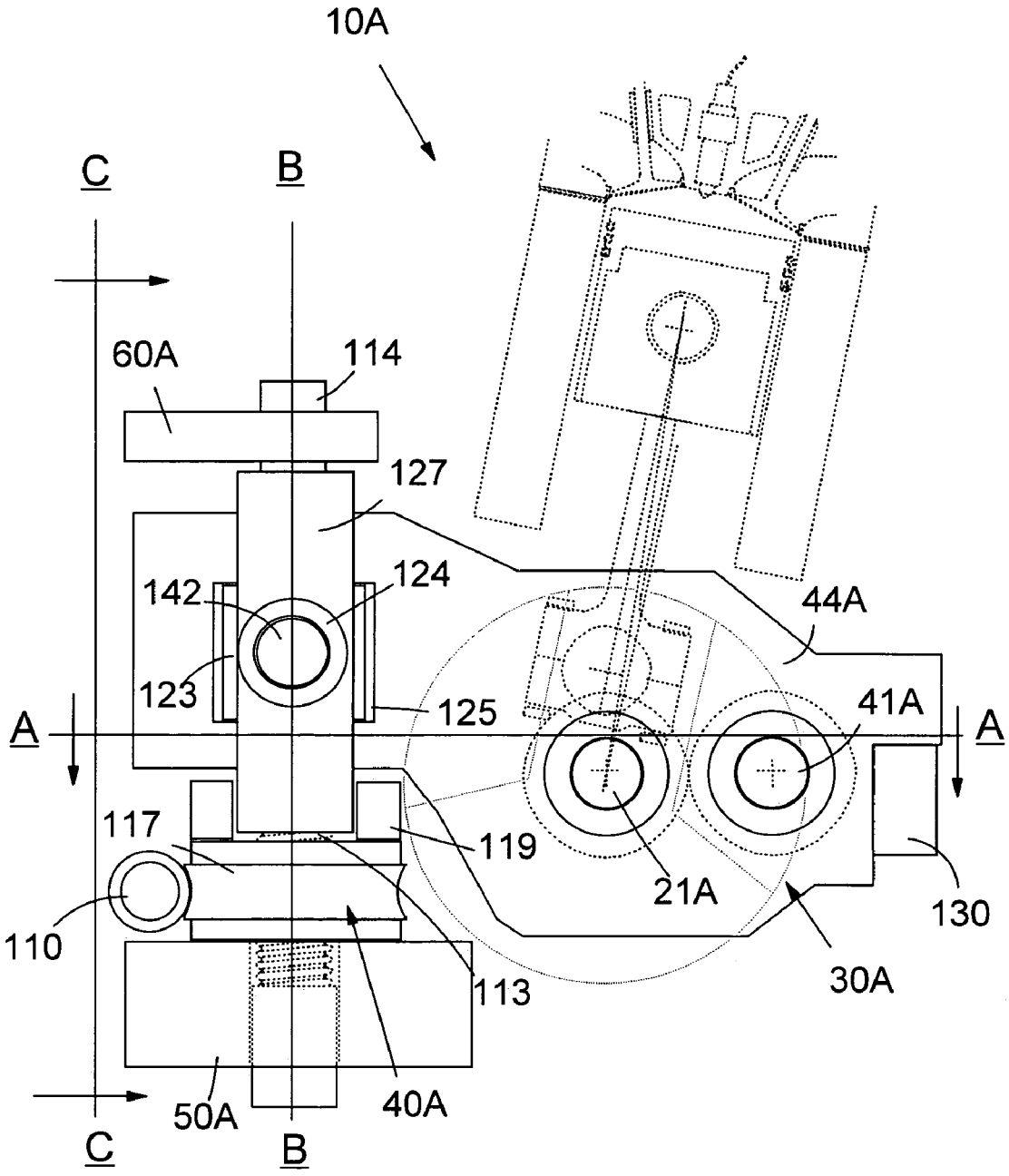
FIG. 1 is a cross-sectional view of a VCR engine of the preferred embodiment with an emphasis on a jackscrew assembly and a crankshaft-driveshaft arm assembly taken from D—D of FIG. 3.
Figure 3:
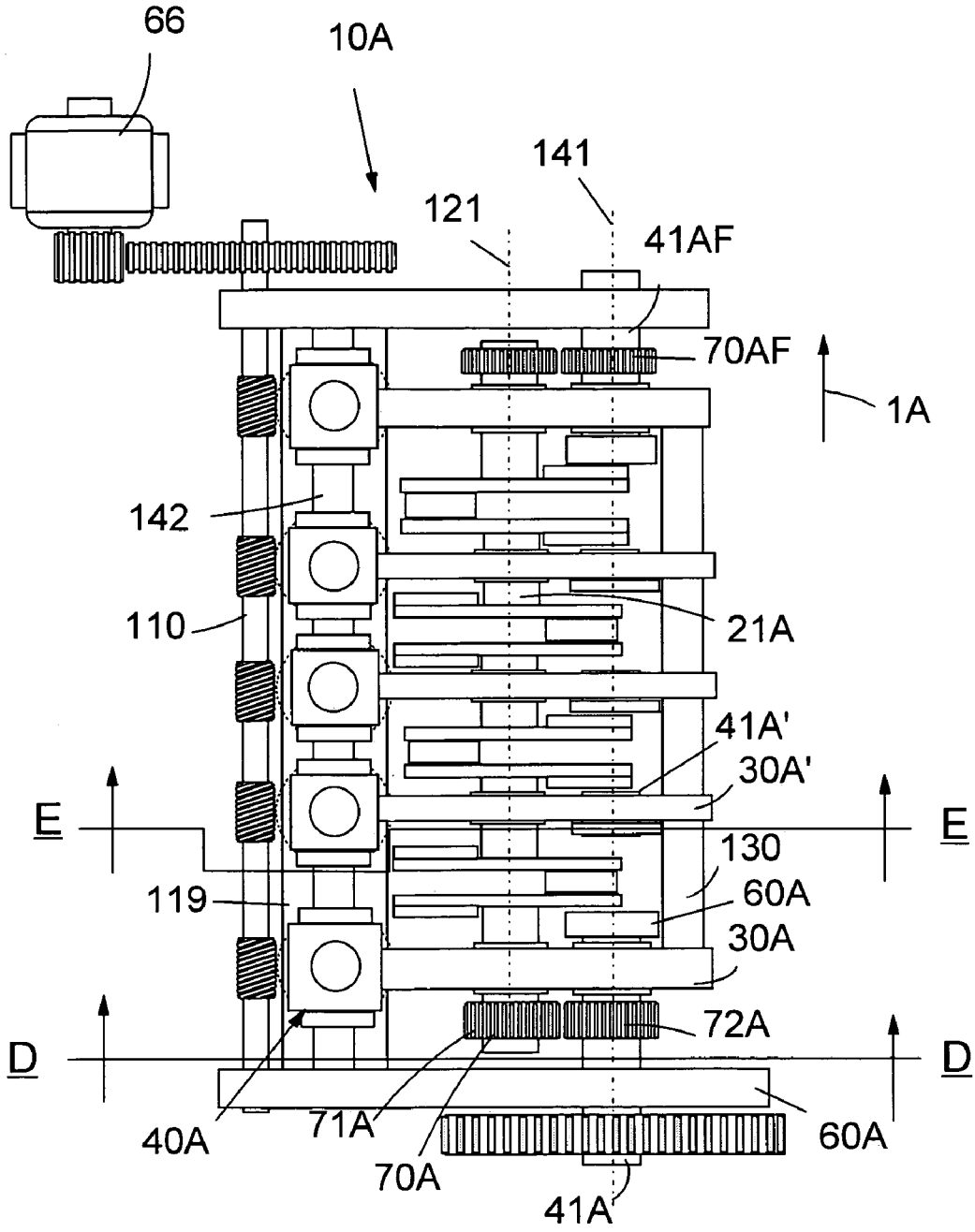
FIG. 3 is a cross-sectional view of the VCR engine of the preferred embodiment taken along A—A of FIG. 1.

FIG. 1 is a cross-sectional view of an internal combustion engine having a variable compression ratio (or in short, a VCR engine) 10A of the preferred embodiment taken along D—D of FIG. 3. The VCR engine 10A has a cylinder block with at least one group of bores arranged in a row, and each row of cylinder bores is longitudinally in line, receiving a plurality of cylinders.

The VCR engine 10A of the preferred embodiment includes a crankshaft 21A, two crankshaft-driveshaft arm assemblies 30A, a driveshaft 41A, a driveshaft extension 41AF, a cylindrical-shaped connecting beam 142, at least one crankshaft support plate assembly 30A' (see FIGS. 3 through 5), a connecting beam 130, a means to lift the crankshaft up and down, and at least one transmission assembly 70A. The a crankshaft 21A functions generally in the same manner as the crankshaft of any reciprocating engine except that its output must be transmitted to the driveshaft 41A through which the engine's output is transmitted to the externally located transmission. The rotational axis 141 of the driveshaft 41A and the rotational axis 121 of the crankshaft 21A are parallel to one another.

The crankshaft-driveshaft arm assembly 30A comprises a bearing that holds the crankshaft 21A, another bearing that holds the driveshaft 41A (or the driveshaft extension 41AF as shown in FIG. 3), and an arm member 44A, to which a bearing that holds the crankshaft 21A, and another bearing that holds the driveshaft 41A (or the driveshaft extension 41AF) are affixed.

The means to lift the crankshaft up and down includes a plurality of jackscrew assemblies 40A, and means to power the jackscrew assemblies including a motor 66, and worm gear sets and a gear shaft (see FIG. 3).

One set of the crankshaft-driveshaft arm assembly 30A and the jackscrew assembly 40A is employed near the front-end, and another set near the rear-end of the crankshaft. (Here, the expression "front" or "rear" of the engine means the direction of the engine when the engine is loaded on a car in the traditional manner, not mounted in a sideway.) The jackscrew assembly 40A that is powered by the motor 66 (see FIG. 3) lifts the crankshaft-driveshaft arm assembly 30A up and down around the rotational axis 141 of the driveshaft 41A and thus changes the compression ratio. The driveshaft extension 41AF is conceptually an extension of the driveshaft 41A, though they are disconnected from each other, having a rotational axis that coincides with an extension of the rotational axis 141 of the driveshaft 41A.

Figure 2:
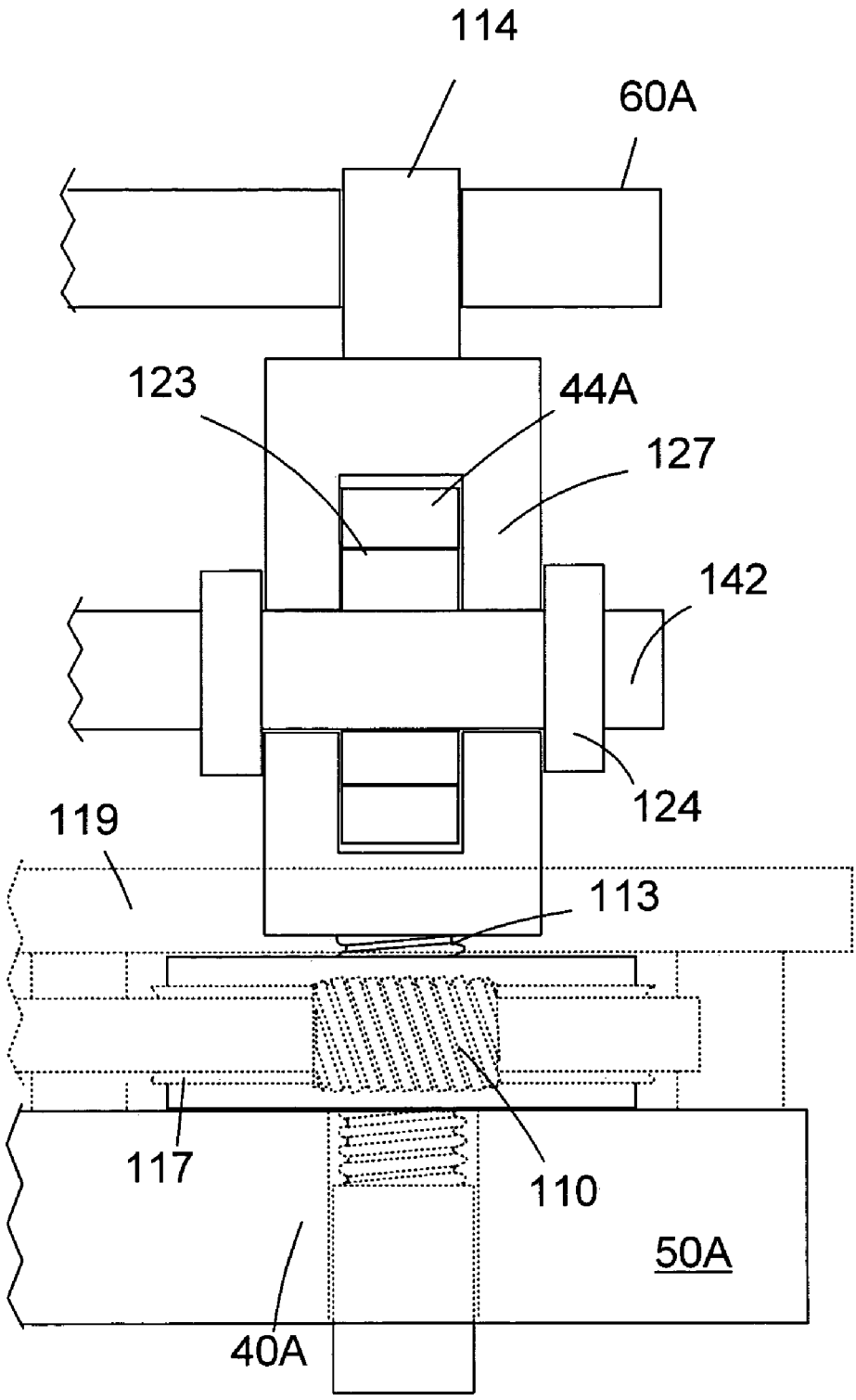
FIG. 2 is an enlarged view of a cross-sectional view of the crankshaft-driveshaft arm assembly and the jackscrew assembly taken along B—B of FIG. 1.

As is shown in FIGS. 1 and 2, the jackscrew assembly 40A is placed in the vertical position with its base plate 50A placed beneath the "handle," or the narrow portion of the arm member 44A, wherein the base plate 50A is affixed to or a part of the engine frame 60A. The handle of the arm member has a hexahedron hole 125 that slidably holds a hexahedron-shaped articulated support means 123, wherein the height of the hexahedron hole 125 is barely tall enough for the hole 125 to contain the support means 123 not to allow undesirable vertical movements of the support means 123; the length of the support means 123 is generally the same as the length of the arm member 44A; and the width of the hexahedron hole 125 is generally wider than the width of the support means 123 to allow lateral movement of the support means 123 while the compression ratio is changed. Note that the "length" of the arm member 44 indicates a measurement taken in longitudinal directions of the engine. The jackscrew assembly comprises an upper spindle 114, an arm holder 127, a lower spindle 113, a thimble with a worm gear 117, a pair of metal pieces 124, the base plate 50A, and a frame 119.

The arm holder 127 has front and rear walls, top and bottom walls, and a hollow hexahedron-shaped inner space with open-ended two sides. The hollow inner space of the arm holder 127 slidably receives front and rear surfaces of the handle of the arm member 44A in such a manner that the front and rear walls of the arm holder 127 generally slidably covers the hexahedron hole 125, and is able to hold the articulated support means 123 inside the hexahedron hole 125 without causing undesirable movements of the support means 123 in longitudinal directions. The height of the inner space of the arm holder 127 is generally taller than the height of the handle of the arm member 44A to allow up and down movements of the arm member for changing the compression ratio. The hexahedron-shaped articulated support means 123 held by the arm holder 127 in the hexahedron hole 125 has a longitudinally extending cylindrical hole, and each of the front and rear walls of the arm holder 127 has a longitudinally extending cylindrical hole. The hole of the articulated support means 123 and two holes of the arm holder are longitudinally aligned, and through which holes a cylindrical-shaped connecting shaft 142 extends. The metal piece 124 is affixed to the connecting shaft at each end of the arm holder 127.

The lower spindle 113 of the jackscrew assembly 40A has an upper part with a thread, and a lower cylindrical-shaped part. The bottom of the upper spindle 114 is affixed to the upper wall of the arm holder 127, and the upper portion of the upper spindle 114 is slidably received by a cylindrical-shaped hole of the engine frame 60A. The upper part of the lower spindle is affixed to the bottom wall of the arm holder 127, and the lower cylindrical-shaped part of the lower spindle 113 is slidably received by a cylindrical-shaped hole of the engine frame 60A. The upper spindle 114 and the lower spindle 113 prevent the jackscrew assembly 30A from moving in horizontal directions.

Figure 4:
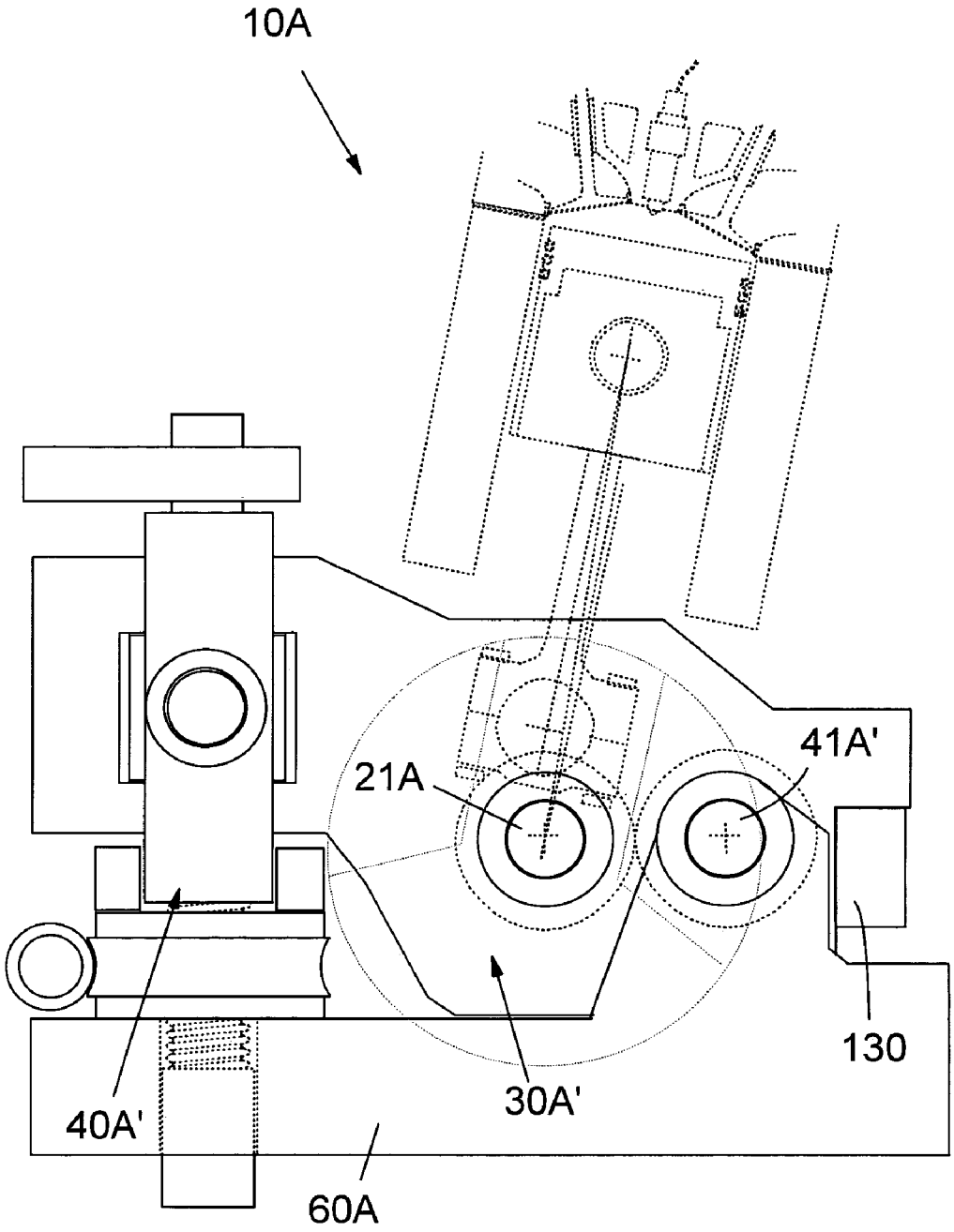
FIG. 4 is a cross-sectional view of the VCR engine of the preferred embodiment taken along E—E of FIG. 3.

The frame 119 of the jackscrew assembly 30A is affixed to the engine frame 60A (see FIGS. 3 and 4). The frame 119 of the jackscrew assembly slidably holds the thimble and the worm gear 117, and prevents the worm gear 117 from moving in vertical directions at any time, and prevents the spindles and the arm holder 127 from moving in vertical directions while the compression ratio remains unchanged.

The jackscrew assembly 40A is driven by a worm 110 and a worm gear 117. When the worm gear 117 rotates, the arm holder 127 moves up and down, and thus the driveshaft-crankshaft support assembly 30A, and the arm member 44A pivots around the axis 141 of the driveshaft 41A, and lifts the crankshaft up and down. The up-and-down movement of the driveshaft-crankshaft support assembly 30A causes to change the compression ratio. While changing the compression ratio, the hexahedron-shaped articulated support means 123 slides in lateral directions within the hexahedron hole 125, and the wall of the cylindrical space within the articulated support means 123 pivots around the axis of the connecting shaft 123.

FIG. 3 is a cross-sectional view of the VCR engine of the preferred embodiment taken along A—A of FIG. 1. The driveshaft 41A is located near the rear end of the engine 10A, and is supported by the engine frame 60A. The arrow 1A indicates the front of the engine. The transmission assembly 70A that comprises a crankshaft gear 71A (affixed to the crankshaft 21A) and a driveshaft gear 72A (affixed to the driveshaft 41A) is placed between the crankshaft-driveshaft arm assembly 30A and the engine frame 60A. The crankshaft-driveshaft arm assemblies 30A and the crankshaft support plate assemblies 30A' are connected together by the metal beam 130, and by the connecting shaft 142. The driveshaft 41A does not extend to the front end of the engine. The motor 66 powers the jackscrew assembly 40A via the worm 110 and the worm gear 117. Another transmission assembly 70AF is mounted on the crankshaft 21A and the driveshaft extension 41AF near the front end of the engine for the purpose of driving accessories.

FIG. 4 shows a cross-sectional view of the crankshaft support plate assembly 30A' taken along E—E of FIG. 3. The crankshaft support plate assembly 30A' that is located between beneath each pair of pistons is generally identical to the drive-shaft-crankshaft arm assembly 30A except that the arm member of the crankshaft support plate assembly 30A' may be slightly shorter (or thinner in ordinary expression) than that of the crankshaft-driveshaft arm assembly 30A, and that the crankshaft support plate assembly 30A' is supported not by the driveshaft 41A or the driveshaft extension 41AF, but by a cylindrical pin 41A' having an axis that coincides with an extension of the rotational axis 141 of the driveshaft 41A and rotates around it. The cylindrical pin 41A' is affixed to the engine frame 60A. The support plate assembly 30A' is lifted up and down by a jackscrew assembly 40A', which is generally identical to the jackscrew assembly 40A in design (see FIG. 1).

Figure 5:
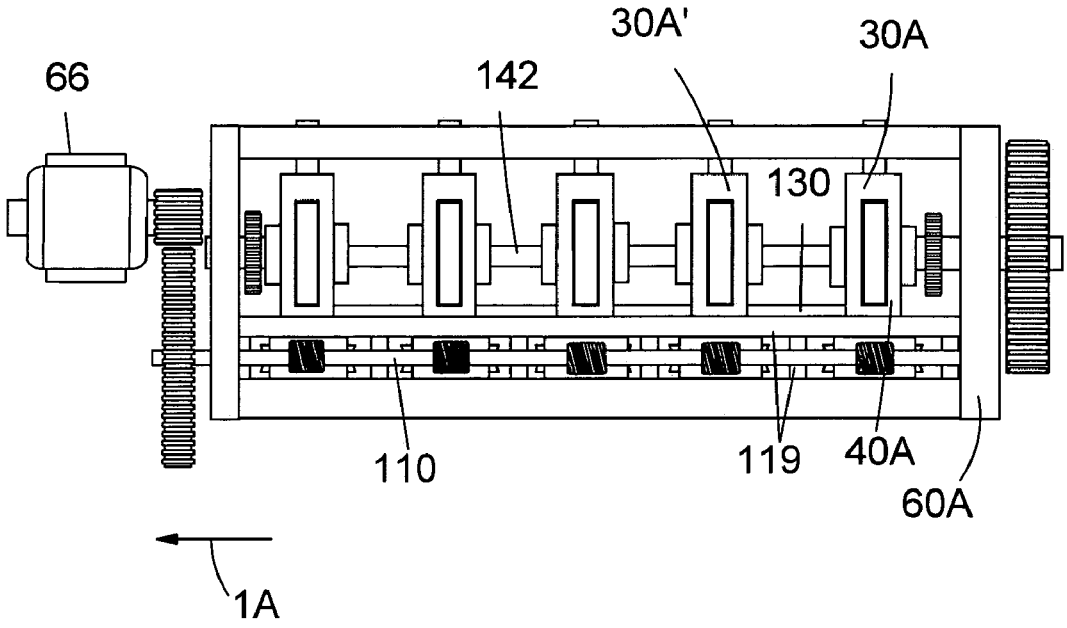
FIG. 5 is a side view of the VCR engine of the preferred embodiment taken from C—C of FIG. 1.

FIG. 5 shows a side view of the VCR engine 10A of the preferred embodiment taken from C—C of FIG. 1. The arrow 1A indicates the front of the engine. The motor 66 that drives the jackscrew assemblies 40A is mounted in front-end (left side of FIG. 4) of the engine, and motor shaft is rotatably connected to the worm 110. The connecting shaft 142 and the connecting beam 130 extend horizontally connecting the crankshaft-driveshaft arm assemblies 30A and the crankshaft support assemblies 30A'. The objective of the use of the connecting shaft 142 and the connecting beam 130 is to ensure that the crankshaft is kept rigid enough and endure the constantly lifted-up-and-down activity.

Figure 6:
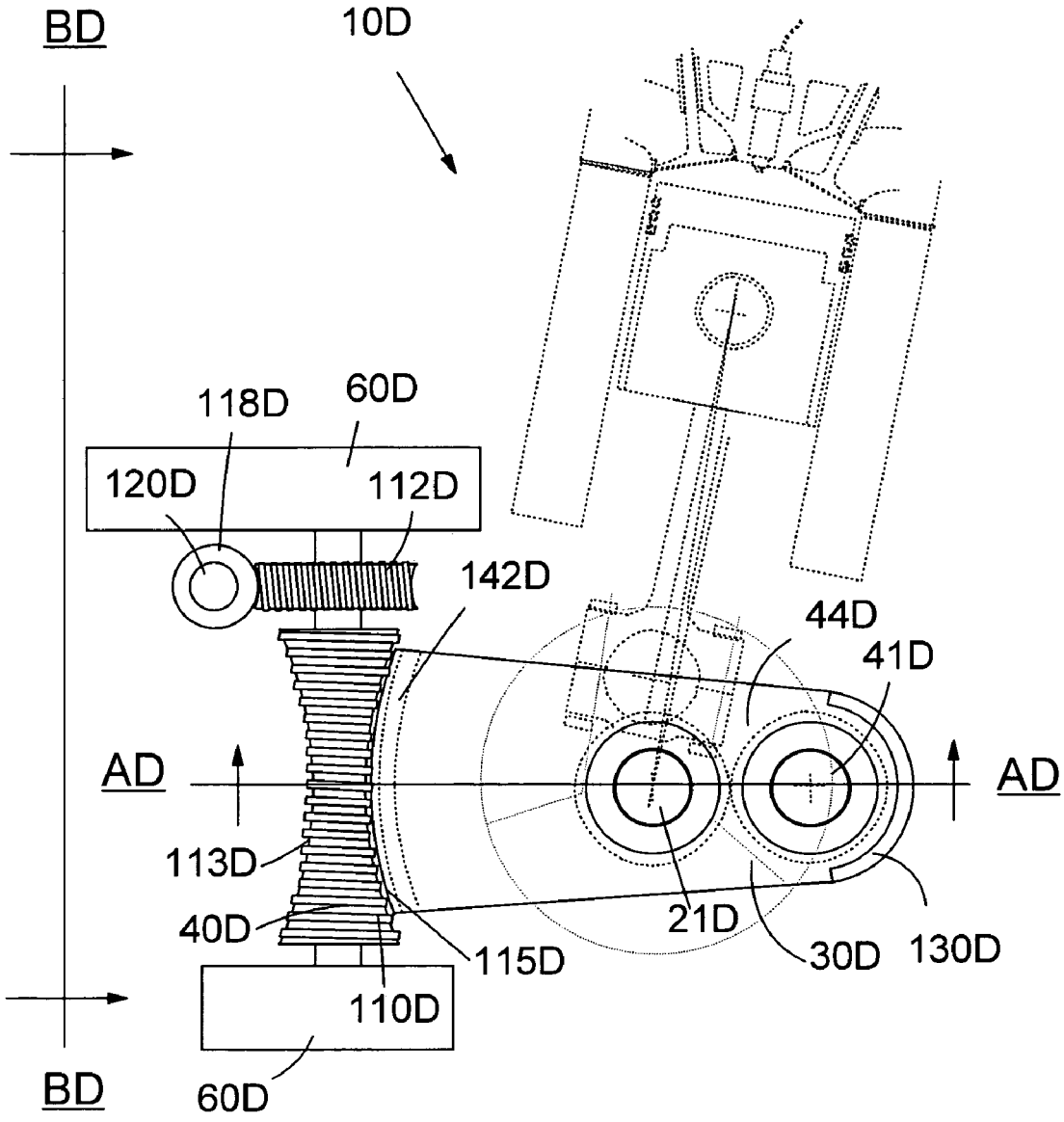
FIG. 6 is a cross-sectional view of a VCR engine of an alternative embodiment taken along CD—CD of FIG. 7.
Figure 7:
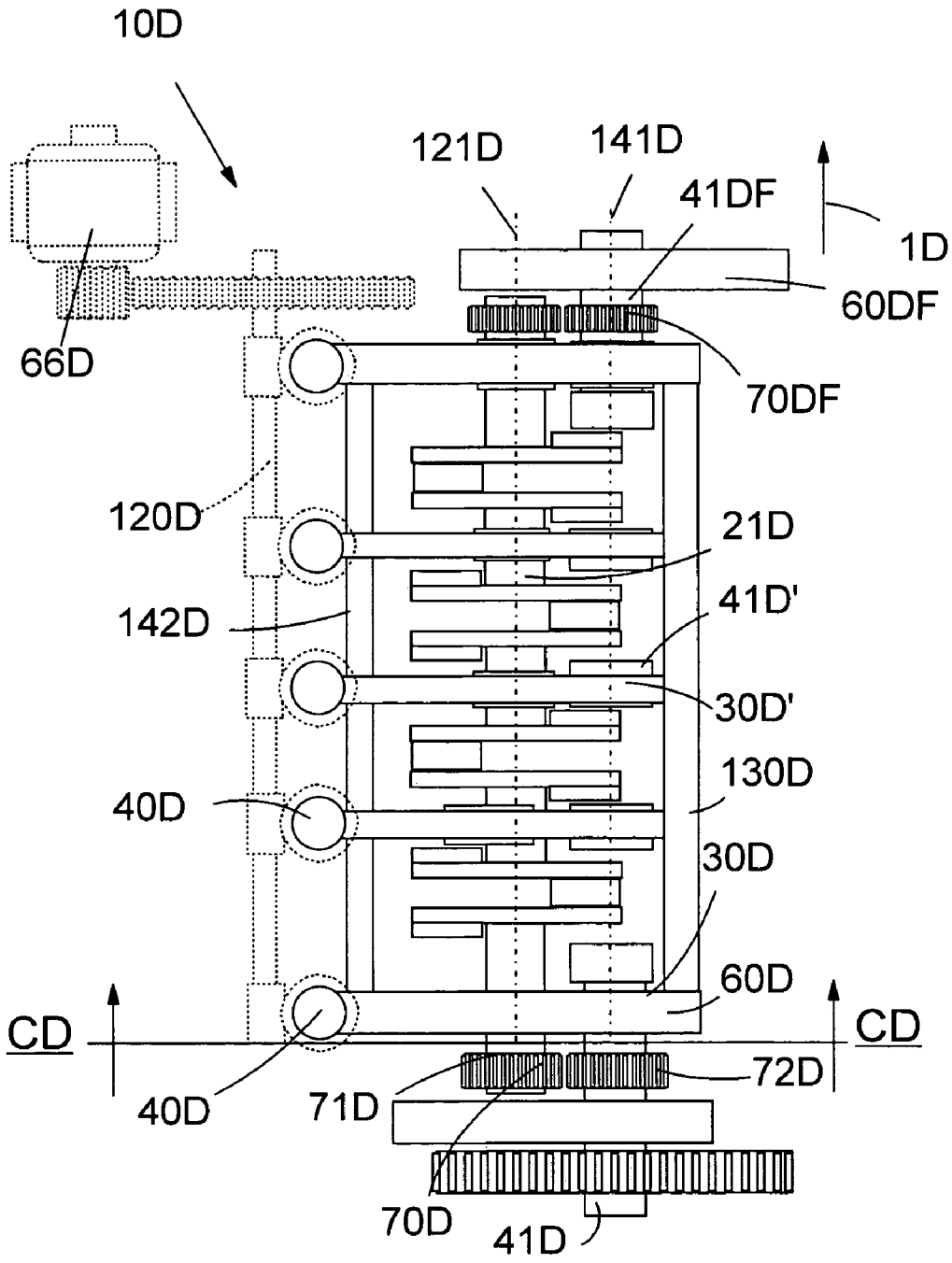
FIG. 7 is a cross-sectional view of the VCR engine of the alternative embodiment taken along AD—AD of FIG. 6.

FIG. 6 is a cross-sectional view of a VCR engine 10D of an alternative embodiment taken along CD—CD of FIG. 7. The engine 10D has a cylinder block with at least one group of bores, and each row of cylinder bores is longitudinally in line, and has at least one cylinder. The engine 10D has a driveshaft 41D through which the engine's output is transmitted to the externally located transmission, and a crankshaft 21D, which functions generally in the same manner as the crankshaft of any reciprocating engine except that its output must be transmitted to the driveshaft. The rotational axis 141D of the driveshaft 41D and the rotational axis 121D of the crankshaft 21D are parallel.

The VCR engine of the alternative embodiment 10D includes two crankshaft-driveshaft arm assemblies 30D, a crankshaft 21D, a driveshaft 41D, a driveshaft extension 41DF, at least one crankshaft support plate assembly 30D', a means to lift the crankshaft 21D up and down, at least one transmission assembly 70D, and connecting metal plates 130D, and 142D. The crankshaft-driveshaft arm assembly 30D comprises an arm member 44D, a bearing that holds the crankshaft 21D, and another bearing that holds the driveshaft 41D. The means to lift the crankshaft 21D up and down includes a motor 66D (see FIGS. 7 and 8) and a plurality of worm gear assemblies 40D.

The worm gear assembly 40D comprises the worm 113D of a worm gear set and a shaft 110D. The pitch diameter of the worm 113D varies. The pitch diameters of the worm 113D at the top and the bottom of the worm are larger than the pitch diameter of the worm at the mid-section. Usual worm of a worm gear set has a constant pitch diameter. But, the worm of a constant pitch diameter will limit the number of teeth meshing together at a time to a few teeth. The worm 113D of a varying pitch diameter increases the number of meshing gear teeth at a time.

The crankshaft-driveshaft arm assembly 30D comprises an arm member 44D, and the bearings affixed to the arm member 44D for the crankshaft 21D and the driveshaft 41D. A partial cylindrical surface of the arm member 44D is fitted with teeth and functions as the worm gear 115D of the worm gear set, and the worm 113D is a part of the worm gear assembly 40D. Even though the worm gear assembly does not include the worm gear, it is called as such only for convenience. The worm gear assembly 40D is driven by another worm gear set that includes a worm 118D and a worm gear 112D. The worm gear 112D is mounted on the shaft 110D that is supported by the engine frame.

Figure 8:
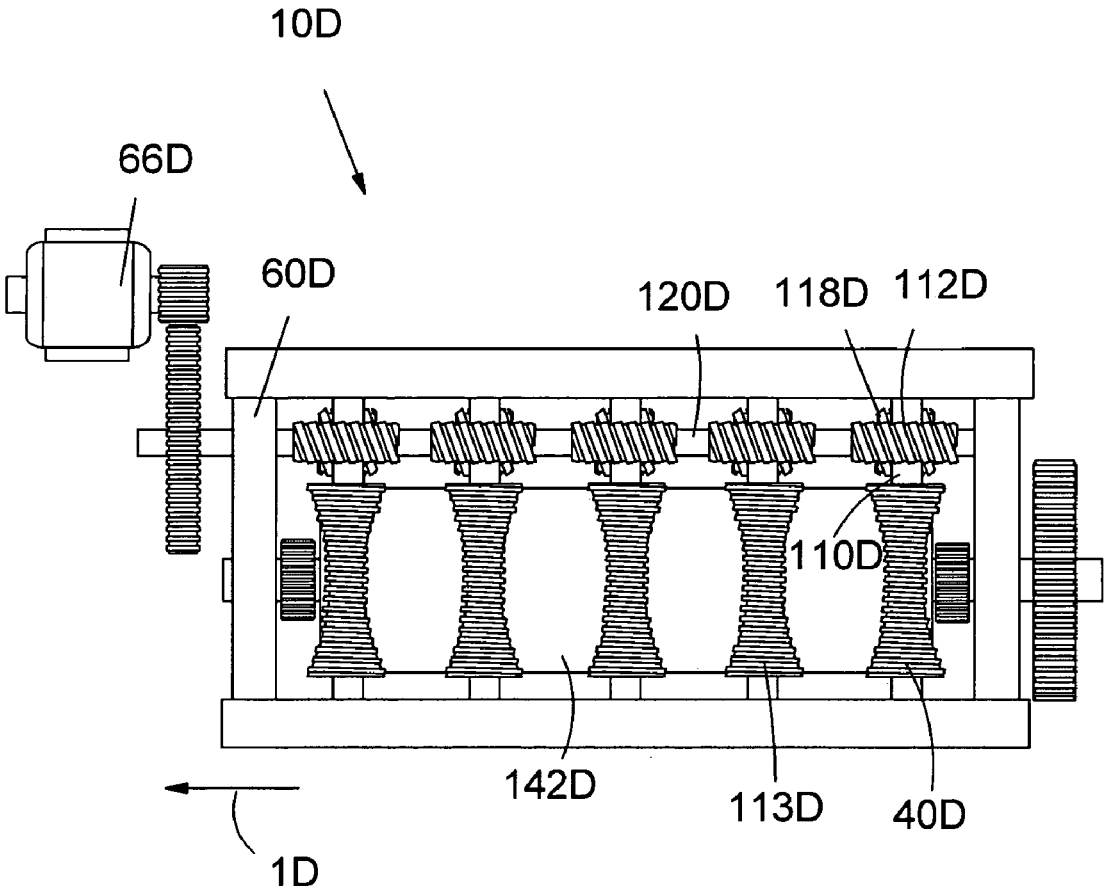
FIG. 8 is a side view of the VCR engine of the alternative embodiment taken from BD—BD of FIG. 6.

As is shown in FIGS. 7 and 8, the driveshaft 41AD is located near the rear end of the engine 10D, and is supported by the engine frame 60D. The arrow 1D indicates the front of the engine. The driveshaft extension 41DF powered by a transmission assembly 70DF is for the accessories near the front end of the engine. The means to lift the crankshaft up and down includes at least two worm gear assemblies 40D. One set of the crankshaft-driveshaft arm assembly 30D and the worm gear assembly 40D is employed near the front-end, and another set near the rear-end of the crankshaft.

The crankshaft support plate assembly 30D' that is located between beneath each pair of pistons is generally identical to the drive-shaft-crankshaft arm assembly 30D except that the arm member of the crankshaft support plate assembly 30D' may be slightly shorter (or thinner in ordinary expression) than that of the crankshaft-driveshaft arm assembly 30D, and that the crankshaft support plate assembly 30D' is supported by a cylindrical pin 41D' having an axis that coincides with an extension of the rotational axis 141D of the driveshaft 41D. The cylindrical pin 41D' is affixed to the engine frame 60D. The crankshaft-driveshaft arm assemblies and the crankshaft support plate assemblies are connected together by a partial cylindrical shaped metal plate 130D, and partial cylindrical shaped metal plates 142D.

As is shown in FIG. 8, the motor 66D that drives the worm gear assemblies 40D is installed in front-end (left side of FIG. 8) of the engine 10D, and the motor shaft is rotatably connected to the gear that is mounted on the shaft 120D. The gear 118D mounted on the shaft 120D meshes with the gear 112D mounted on the shaft 110D. The shafts 110D and 120D are rotatably mounted on the engine frame 60D.

In operation, an onboard computer equipped with necessary memory and software (1) measures the current operational conditions and the relative height D of the top or bottom surface of the crankshaft from an arbitrary point, (2) receives a desired height D or an estimated desired height D, and (3) varies the height D from current level to the desired level. In addition, the computer is connected to the knocking sensor, and if knocking is detected, then the computer will immediately lower the height D.

The invention having been described in detail in accordance with the requirements of the U.S. Patent Statutes, various other changes and modifications will suggest themselves to those skilled in this art. For example, no crankshaft support plate assemblies may be used in an engine, or more than two crankshaft-driveshaft arm assemblies may be used in one engine. Pneumatic pistons and a cylinder with oil pressure may be used as a means to power the jackscrew and the gear set. It is intended that the above and other such changes and modifications shall fall within the spirit and scope of the invention defined in the appended claims.

I claim:

1. An internal combustion engine having a variable compression ratio including a crankshaft, a driveshaft, a plurality of crankshaft-driveshaft arm assemblies, a transmission assembly, and a means to lift up and down said crankshaft, wherein said crankshaft being parallel to said driveshaft, said crankshaft-driveshaft arm assembly having an arm member, and first and second bearings, said first and second bearings of said crankshaft-driveshaft arm assembly affixed to said arm member, said first bearing rotatably receiving said crankshaft and said second bearing rotatably receiving said driveshaft, said transmission assembly having first and second gears wherein said first gear is affixed to said crankshaft, and said second gear affixed to said driveshaft, said means to lift up and down said crankshaft including a plurality of jackscrew assemblies, said jackscrew assembly including an arm holder, a spindle, and a frame, wherein said arm holder slidably receiving said arm member of said crankshaft-driveshaft arm assembly, said crankshaft-driveshaft arm assemblies being connected together by at least one metal beam, said crankshaft-driveshaft arm assembly having an articulated support means, said articulated support means having a cylindrical hole, said arm holder having front and rear walls, each having a cylindrical hole, said cylindrical hole of said articulated support means, and said cylindrical holes on said front and rear walls of said arm holder are longitudinally aligned, and a connecting shaft extends through said holes of said arm holder and said articulated support means.

2. An internal combustion engine as defined in claim 1 wherein said means to lift up and down said crankshaft includes a plurality of jackscrew assemblies.

3. An internal combustion engine as defined in claim 2 wherein said transmission assembly having first and second gears wherein said first gear is affixed to said crankshaft, and said second gear affixed to said driveshaft, and said first and second gears mesh together.

4. An internal combustion engine having a variable compression ratio including a crankshaft, a driveshaft, a plurality of crankshaft-driveshaft arm assemblies, at least one crankshaft support plate assembly, a transmission assembly, and a means to lift up and down said crankshaft, wherein said crankshaft being parallel to said driveshaft, said crankshaft-driveshaft arm assembly having an arm member, and first and second bearings, said first and second bearings of said crankshaft-driveshaft arm assembly affixed to said arm member, said first bearing rotatably receiving said crankshaft and said second bearing rotatably receiving said driveshaft, said crankshaft support plate assembly having an arm member, and first and second bearings, said first and second bearings of said crankshaft support plate assembly affixed to said arm member, said first bearing rotatably receiving said crankshaft and said second bearing rotatably receiving a cylindrical pin, wherein said cylindrical pin having an axis, said axis of said cylindrical pin coincides with extension of rotational axis of said driveshaft, said transmission assembly having first and second gears wherein said first gear is affixed to said crankshaft, and said second gear affixed to said driveshaft.

5. An internal combustion engine as defined in claim 4 wherein said means to lift up and down said crankshaft includes a plurality of worm gear assemblies.

6. An internal combustion engine as defined in claim 4 wherein said crankshaft-driveshaft arm assemblies being connected together by metal beams.

7. An internal combustion engine as defined in claim 4 wherein said transmission assembly having first and second gears wherein said first gear is affixed to said crankshaft, and said second gear affixed to said driveshaft, and said first and second gears mesh together.

8. An internal combustion engine as defined in claim 7 wherein said crankshaft-driveshaft arm assemblies being connected together by at least one metal beam.

* * * * *